United States Patent [19]

Nielsen

[11] 4,036,523

[45] July 19, 1977

[54] CHILD'S CHAIR

[76] Inventor: Knud Nielsen, Mosebakken 16, 2830 Virum, Denmark

[21] Appl. No.: 615,877

[22] Filed: Sept. 22, 1975

[30] Foreign Application Priority Data

Sept. 25, 1974 Denmark ..... 5055/74

[51] Int. Cl.[2] ..... A47C 4/00

[52] U.S. Cl. ..... 297/130; 297/3; 297/56

[58] Field of Search ..... 297/56, 29, 16, 130, 297/118, 1, 3, 154

[56] References Cited

U.S. PATENT DOCUMENTS

| | | | |
|---|---|---|---|
| 1,621,930 | 3/1927 | Hoy | 297/154 X |
| 1,928,991 | 10/1933 | Bishop | 297/56 |
| 2,902,084 | 9/1959 | Stevens | 297/29 |
| 2,984,291 | 5/1961 | Kostenborder | 297/153 |
| 3,269,771 | 8/1966 | Erdos | 297/118 X |
| 3,352,602 | 11/1967 | Svendsen | 297/3 X |
| 3,656,804 | 4/1972 | Nielsen | 297/3 |

*Primary Examiner*—James T. McCall
*Attorney, Agent, or Firm*—Nolte and Nolte

[57] ABSTRACT

A child's chair comprises a pair of pivotally connected frames which are secured in an erected position by a pair of linking frames of which, at any given time, one acts as a strut and the other acts as a tie, and a seat is suspended within the frames.

16 Claims, 9 Drawing Figures

CHILD'S CHAIR

Figure 1:
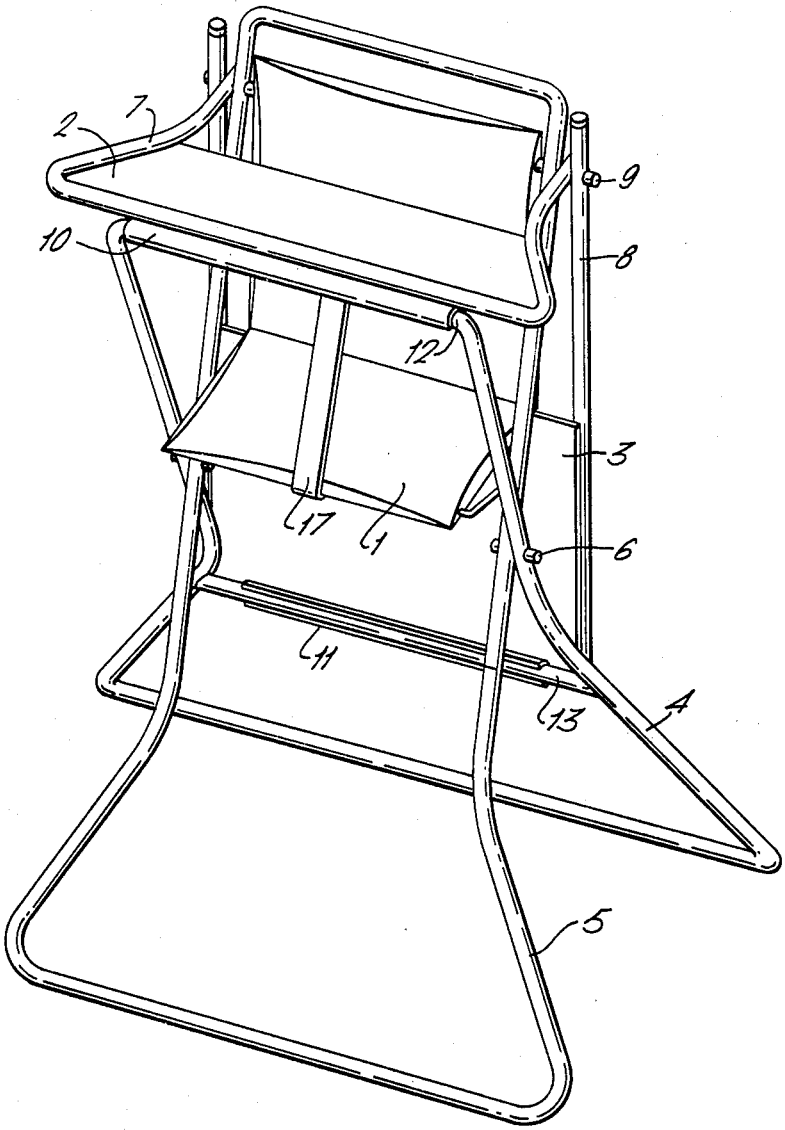

The invention relates to a child's chair composed of a frame, preferably of steel tubes and a seat suspended therein.

Such child's chairs are easy to clean, very durable and can be produced relatively inexpensively. They are, therefore, produced in mass production and detachably, so that they can be packed and sent economically. In many applications it may be desirable to be able to fold up the chair and put it aside without having to make any real detachment. Hitherto it has not been possible to devise a chair of the said type, which can be folded up sufficiently easily without getting hereby into conflict with the very heavy requirements of safety, which distinguish such chairs from other like furniture structures, as it will be understood, that a child which is left alone in the chair must not be able to cause a falling apart of same by fiddling with parts within its reach, no more than playing children moving about the chair must be able to cause a falling apart of the chair by inadvertently pushing to it.

The object of the invention is to devise a chair of the said type, which is inexpensive to produce, and which can be folded up quickly, without any risk that such folding up can be released unintentionally, while a child is sitting in the chair.

This is, according to the invention, achieved by the frame being composed of two flat, large frames, which are turnably connected near their centres, and of two flat, smaller frames, which are arranged for attachment in each their angle space between the two larger frames and hereby each to lock the latter in a predetermined angle position, whereby each of the two smaller frames are turnably connected with the other parts of the frame at one end and disconnectably connected with the other parts of the frame at the other end. Hereby a double safety is obtained, which has proved in practice in fact to preclude an unintentional collapsing of the chair. It will only be possible to fold up the chair together with a swinging out of both the two smaller frames which are situated in each their angle space. A child which is placed in the chair in one of the angle spaces between the two large frames may be able to reach the parts of the chair being situated in the angle space in question while the inter locking frame in the other angle space will be outside its reach. On a push against the chair one of the interlocking frames may be affected, but a simultaneous disconnection of the other interlocking frame will demand an influence in another direction, and it will be possible to choose the two necessary directions of force so, that the necessary direction of force in both directions simultaneously cannot be obtained by a single push with a force, that the chair must be able to stand. As the smaller, flat interlocking frames can be used parts forming parts of the chair, whereby it will be possible to produce the chair without essentially higher costs than corresponding previously known chairs of the same type. The use of two interlocking frames gives the chair a very high grade of stability.

According to the invention the two angle spaces with the two smaller frames may be adjoining each other. There may then be used a common hinge- or locking mechanismus for the two smaller frames.

According to the invention the four frames may be frames of flat steel tubes. Such frames can be produced very inexpensively in mass production.

Accoding to the invention the smaller frames may at their disconnectable end have means, which are able to grip resiliently round a transversal tube of one of the large frames. Hereby is obtained an inexpensive and very durable locking mechanism, which is easy to handle.

According to the invention the resilient means may consist of resilient slotted tubes. Such locking means are particularly durable and particularly inexpensive to produce.

According to the invention the two smaller frames may at their one end be hinged to one of the two large frames near the one end of same. There may then be used a common hinging mechanism for the two frames and when collapsing the chair a pull in two directions away from the centre of the chair is demanded, i.e. opposite the directions in which the chair will usually be influenced in case of incidental pushing influences.

According to the invention the two smaller frames may be hinged to one of the large frames near each its end of same. There may then be used a common locking mechanism for the two smaller frames, and in many cases will be particularly handy to operate.

According to the invention the two smaller frames may be hinged to each one of the two large frames at or near their ends. Hereby a structure is obtained, which may be space-saving in folded-up condition.

According to the invention one of the smaller frames may at one end be hinged to one of the large frames at or near its end, while the other of the smaller frames is hinged to the other end of the smaller frames. A disconnection of the former of the smaller frames will then be blocked, as long as the other of the smaller frames is not disconnected.

According to the invention one of the smaller frames or both may be a table plate which is situated abreast of the suspended seat. As interlocking frames may then be used parts forming parts of the chair.

According to the invention one of the two smaller frames or both may have connection means, by means of which they can, at a distance from their hinging axis, be assembled with the other parts of the frame. A further safety is then obtained, as the interlocking frames cannot be disconnected for collapsing the chair until these connecting organs have been released.

According to the invention the two smaller frames can be interconnected at a distance from their hinging axis by means of the connection members. Both two locking frames can then be secured simultaneously by means of a single set of connecting organs.

According to the invention the connecting members may consist of a strap and a buckle which is attached to one or each of the smaller frames. Hereby a set of strong and inexpensive connecting members is obtained.

According to the invention there may be a hole in the buckle, through which the strap can be pulled, and a pin which can get into an aperture in that end of the strap which is pulled through the buckle. Such a buckle is inexpensive and very easy to handle.

Figure 7:
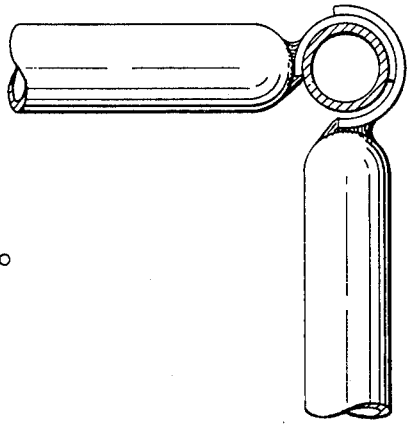
Figure 9:
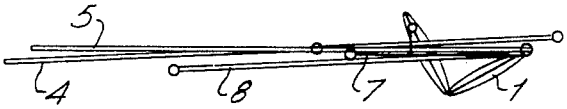

The invention will be explained more in detail below with reference to the drawing, wherein, FIG. 1 shows a first embodiment of a child's chair according to the invention as viewed in perspective and in the high position, FIG. 2 the chair in side elevation in the low position, FIG. 3 a schematic illustration of the frame of the chair in side elevation, FIGS. 4, 5 and 6 schematical illustrations of the frame of three other embodiments of a child's chair according to the invention in side elevation, FIG. 7 interlocking organs for a child's chair according to the invention, FIG. 8 connecting organs for a child's chair according to the invention, and FIG. 9 schematical illustration of a child's chair according to the invention in folded up condition, in side elevation.

The child's chair shown in the drawing has a frame, in which is suspended a seat 1, which can be used in two different positions of use of the chair with a table plate, 2 resp. 3 in front of the seat in each of the two positions of the chair. The frame is composed of two large, closed, plane frames of steel tubes 4 and 5, which are hinged near their centre by means of two screws 6, with the frame 5 inside the frame 4. Two smaller, plane frames 7 and 8 of steel tube which are open at the one end, are at the open end hinged to a rod 9, which carries the backrest of the seat 1, and which is attached to the frame 5 near the one end of same. The two smaller frames 7 and 8 carry each one of the table plates 2 and 3 and at the closed end they have a slotted, resilient tube 10 resp. 11, which can grip about the one end 12 of the frame 4 respectively a transversal tube 13 near the other end of the frame 4. At the end next to the hinging rod 9 the two table plates carry each a buckle 14 respectively 15, which are shown more detailed in FIG. 8, and which have a hole through which can put one end of a strap 17, which extends between the two buckles 14 and 15 and a pin 18 which can get into an aperture 19 in that end of the strap 17 which has been put through the hole 16 of the buckle.

Figure 2:
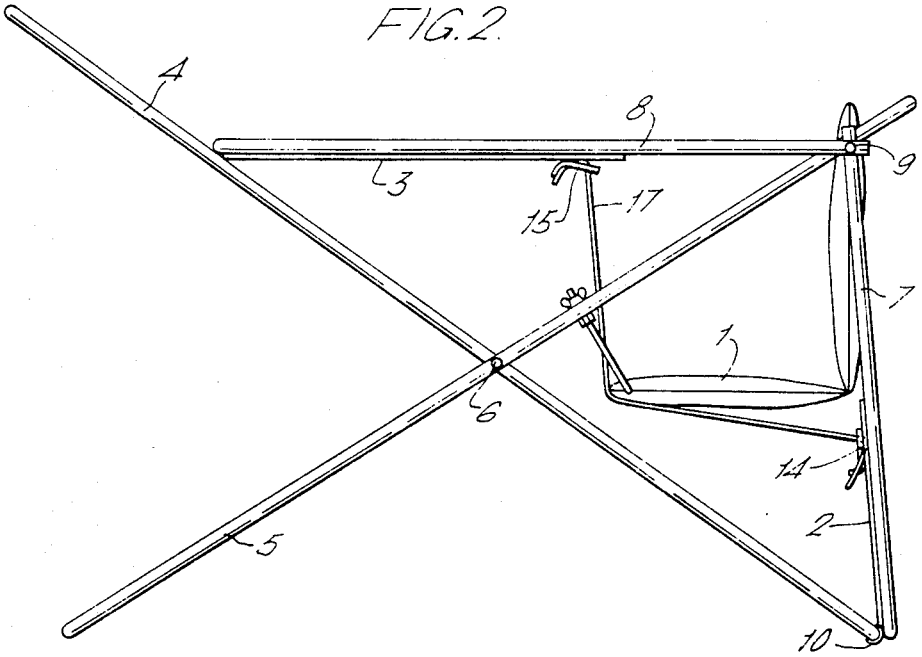

The chair shown in the drawing can be used either in a high position as shown in FIG. 1 or in a low position as shown in FIG. 2, as the seat can be changed from the one position into the other by a pressure in the corner. If it is desired to fold up the chair to put it aside or for transportation, this can be made from the position shown in FIG. 1 by swinging the frame 7 upwards and backwards round the rod 9, whereby the interlocking with the frame 4 is disconnected, and the frame 7 lies flatly to the frame 8. Furthermore the frame 8 is swung backwards, whereby the interlocking between same and the frame 4 is disconnected, after which the frames 4 and 7 can be swung into the frame 5 round the screws 6, whereby the chair is reduced to an abt. eight centimeters thick package, as shown in FIG. 9. A further reduction of this thickness i.e. by for instance for transportation of the chair, may be obtained by loosening the seat 1 where same is fastened to the middle of the frame 5 by screws 20 and 21, and stretchening out the seat in the plane of the frame 5.

Figure 3:
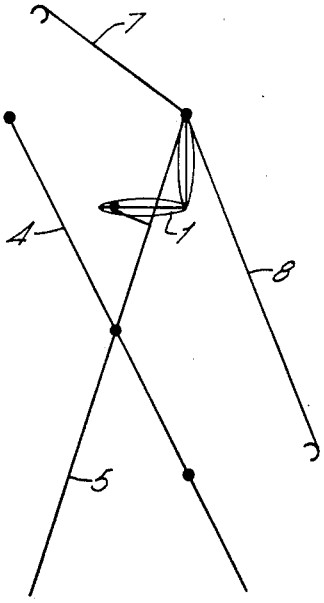
Figure 4:
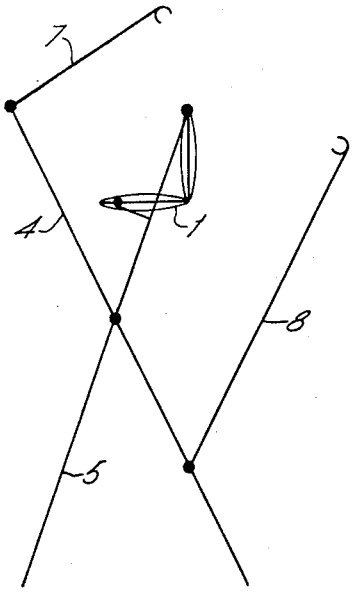
Figure 5:
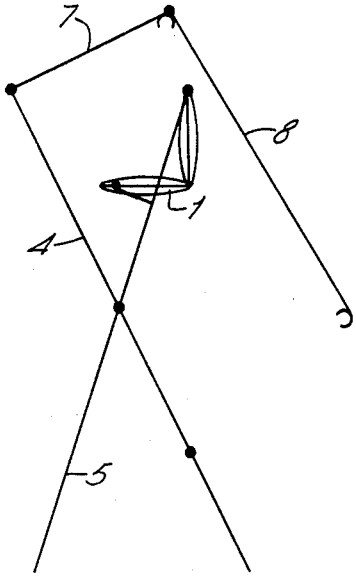

Instead of, as in the chair shown in FIGS. 1 and 2, to have the smaller frames 7 and 8 hinged at one end of the frame 5 and arranged for disconnectable connection with each its side of the frame 4, as shown more detailed in FIG. 3, the frames 7 and 8 may in certain cases advantageously be hinged with each its end of the frame 4 and disconnectably connected with one end of the frame 5 as shown more detailed in FIG. 4. As locking organs at the common place of connection with the frame 5 may then be used a slotted tube which is fastened to each its own of the frames 7 and 8, of which the one fits round a transverse rod at the end of the frame 5 and the other round the former slotted tube, as shown more detailed in FIG. 7. In certain cases the structure shown in FIG. 5 may also advantageously be used, in which structure the frame 7 is at the one end hinged to the end of the frame 4 and at the other end to the end of the frame 8, which has at both ends disconnectable interlocking members by means of which it can be fastened to the one end of each of the frames 4 and 5. In the chair shown in FIG. 5 the frame 7 will not be able to swing upwards and damage a child being placed in the chair, even if a person would move the chair and the child by gripping about the frame 7. This can also be prevented in the structures shown in FIGS. 4 and 6 by letting the frame 8 grip interlocking about the end of the frame 7.

Figure 6:
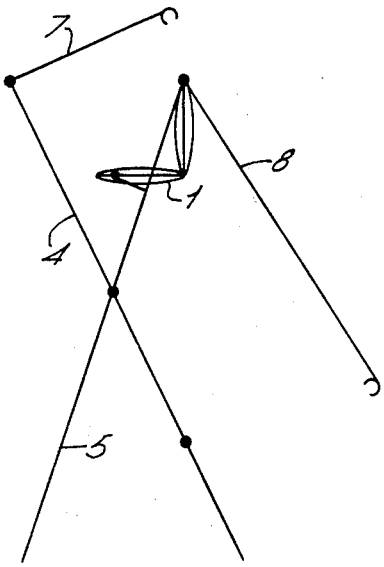

Finally the structure shown in FIG. 6 may in certain cases be advantageous. The frames 7 and 8 are here connected with the one end of each its own of the frames 5 and 4 and grip interlockingly about the end of the frame 4 respectively the end of the frame 7.

Figure 8:
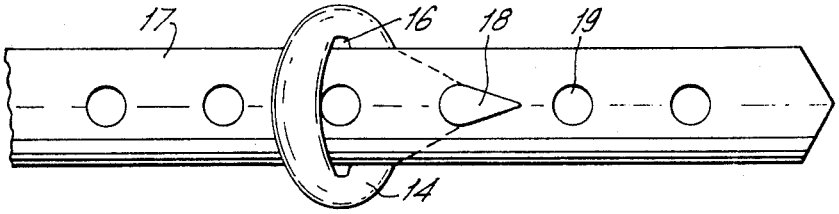

Irrespective of which of the structures shown is used, and irrespective of whether one is trying to lift the chair and the child in the high or in the low position of the chair, a swinging up of one of the frames 7 or 8 under such a moving of the chair could be prevented by assembling the two frames by means of the strap 17 and the buckles 14 and 15 attached to the table plates 2 and 3, which is shown more detailed in FIG. 8. As such a strap, can be used a strap which extends between the child's legs to prevent the child from falling down from the chair.

In the design shown in the drawing, both of the two large frames are shown closed at both ends, and the two smaller frames open at the one end and closed at the other. It will be understood, that the chair may very well be produced with two large frames, which are open at the one end, whereby the chair instead of resting on transverse rods could be arranged to rest on real legs. It will likewise be possible e.g. at the hinging rod 9 in the design shown in FIG. 1 and 2 to let the large frame 5 be closed and one of the smaller frames 7 or 8 be open. Instead of U-shaped smaller frames, it will also be possible to use frames consisting of two steel rods as lateral pieces kept together by a table plate. By modifying the design the frames 7 and 8 can be turned towards each its side of the frame 5 whereby the chair in the folded up position will become very flat.

I claim:

1. A collapsible child's chair comprising first and second, generally planar frames each having opposite ends, pivot means pivoting said frames together intermediate their opposite ends for pivoting movement between an erect and a collapsed condition, first and second substantially rigid linking means each securable to both of said frames to maintain said frames in said erect condition, each said first and second frames having portions extending to opposite sides of said pivot means, each of said linking means being connected to one of said frames at a portion thereof at one side of said pivot means and one of said linking means being connected to the other of said frames at portions thereof on opposite sides of said pivot means, at least one of said linking means having one end thereof permanently and pivotally secured to said frames and the other end thereof being releasably secured to the other of said frames and at least one end of the other of said linking means being releasably secured to one of said frames.

2. A child's chair according to claim 1 wherein those ends of said linking means releasably secured to said frames comprise members which are able to grip resiliently round a transverse tubular element of said frames.

3. A child's chair according to claim 2, wherein said members able to resiliently grip a tubular element comprise resilient, slotted tubes.

4. A child's chair according to claim 1 wherein the linking means are both permanently secured to the same one of said frames.

5. A child's chair according to claim 4 wherein each of said linking means is permanently secured to the same end of said one frame.

6. A child's chair according to claim 1 wherein at least one of said linking means supports a table plate situated in front of the seat defining means.

7. A child's seat according to claim 1 wherein at least one of the linking means has a buckle secured thereto at a distance from the connection of that linking means to a frame.

8. A child's chair according to claim 7 wherein each linking means has such a buckle element and a strap is provided interconnecting said buckle means, the length of the strap between said buckle means being variable.

9. A collapsible child's chair comprising first and second, generally planar frames each having opposite ends, pivot means pivoting said frames together intermediate their opposite ends for pivoting movement between an erect and a collapsed condition, first and second substantially rigid linking means each securable to both of said frames to maintain said frames in said erect condition, one of said linking means constituting tie means and the other of said linking means constituting strut means, and seat defining means secured to one of said frames.

10. A chair as claimed in claim 9 wherein at least one of said linking means is permanently connected at one end to said first frame by pivot means, the other end of said at least one linking means being provided with means for releasably connecting said at least one linking means to said second frame.

11. A chair as claimed in claim 10 wherein said other of said linking means is pivotably connected at one end to said other end of said at least one linking means, the other end of said other of said linking means including means for releasably engaging said second frame.

12. A chair as claimed in claim 9 wherein one end of each of said linking means, in the erect condition, is connected to a common end of one of said frames.

13. A chair as claimed in claim 12 wherein each said one end of said linking means has pivot means permanently securing said linking means to said common end of said one of said frames, each other end of said linking means comprising means for releasably engaging the other of said frames.

14. A chair as claimed in claim 12 wherein the end of one of said linking means is releasably connected to said common end of said one of said frames and the other end of said one of said linking means is permanently and pivotally connected to said other of said frames.

15. A chair as claimed in claim 12 wherein one end of each linking means is releasably connected to said common end of said one of said frames, the other ends of said linking means being permanently and pivotally connected to the other of said frames.

16. A child's chair as claimed in claim 4 wherein each said linking means is connected to said frame at opposite sides of the pivotal connection of that frame to the other frame.

* * * * *